United States Patent [19]

Coucher

[11] 3,942,730

[45] Mar. 9, 1976

[54] GRAIN MILLING WHEELS

[75] Inventor: Robert G. Coucher, Salt Lake City, Utah

[73] Assignee: Pioneer Associates, Salt Lake City, Utah

[22] Filed: Sept. 3, 1974

[21] Appl. No.: 502,831

[52] U.S. Cl. ..... 241/248; 241/261.2; 241/296

[51] Int. Cl.[2] ..... B02C 7/06; B02C 7/18

[58] Field of Search..... 51/206 R; 241/245, 248, 241/260, 261, 261.2, 261.3, 291, 296

[56] References Cited

UNITED STATES PATENTS

| | | | |
|---|---|---|---|
| 1,286,865 | 12/1918 | Winegardner | 241/261.3 |
| 2,623,700 | 12/1952 | Scherer | 241/261 |
| 2,984,555 | 5/1961 | Curtis | 241/291 UX |
| 3,032,282 | 5/1962 | Asplund | 241/245 X |
| 3,040,996 | 6/1962 | Ginavin | 241/261 X |
| 3,248,189 | 4/1966 | Harris | 241/291 UX |
| 3,496,682 | 2/1970 | Quass et al. | 241/291 UX |
| 3,553,905 | 1/1971 | Lemelson | 51/206 R |
| 3,742,654 | 7/1973 | Darrow et al. | 51/206 R |
| 3,880,367 | 4/1975 | Grover | 241/296 X |

*Primary Examiner*—Granville Y. Custer, Jr.
*Assistant Examiner*—Howard N. Goldberg
*Attorney, Agent, or Firm*—Trask & Britt

[57] ABSTRACT

A matched pair of milling wheels for use in home grain mills includes a stator and a rotor. Each wheel is ideally composite, with a metal casting supporting a peripheral ring of cast stone. When the wheels are mounted in a mill with their peripheral grinding surfaces juxtaposed, their interior sections define a central cavity which functions as a crushing section. The crushing section contains opposed cutting teeth constituting means for primary shearing and grooves spaced between the cutting teeth constituting means for secondary shearing action. The grooves also provide access for grain particles to migrate out toward the grinding interface between the peripheral cast stone rings.

18 Claims, 9 Drawing Figures

GRAIN MILLING WHEELS

BACKGROUND OF THE INVENTION

1. Field

This invention pertains to milling wheels for grain and is particularly directed to a matched pair of such wheels suitable for home grain mills.

2. State of the Art

A large variety of hand-powered and electrical-powered home grain mills is known. Many types and styles of milling wheels have been developed for use in such mills. Some of the milling wheels known to the prior art are constructed entirely of metal, but such wheels are generally not preferred because of the preference for stone ground flour. Milling wheels with stone or cast stone grinding surfaces have been of two types. Some such wheels are cast entirely from ceramic materials. Exemplary of such milling wheels is the matched set disclosed in U.S. Pat. No. 3,688,996. Ceramic wheels of this type produce excellent flour but have attendant disadvantages associated with the extremely poor heat conductivity of the ceramic material from which they are constructed. As a consequence, the grinding surface becomes unduly hot, tending to scorch the flour produced, particularly when wet grain is milled. Moreover, because heat is not readily radiated from the stone surfaces, a large quantity of heat is transferred from the rotor stone into the driven shaft to which it is mounted, thereby causing the shaft to expand. This expansion tends to decrease the spacing between the rotor and stator stones, thereby causing the stones to jam or overload the motor.

Efforts have been made to solve some of the problems associated with the poor heat conductivity of cast stone wheels through the expedient of attaching a cast stone ring to a metallic center. Such efforts have heretofore been unsatisfactory, both because of the relatively large proportion of stone in the composite wheel and because of the difficulties associated with achieving a balanced rotor and with maintaining good alignment between the grinding surface and the axis of the metallic insert.

There thus remains a need for a composite matched set of milling wheels with a stone grinding interface, good heat conductivity and balance, efficient milling characteristics and reliable alignment capabilities.

SUMMARY OF THE INVENTION

The present invention provides a matched set of milling wheels which offers several advantages over the stone, metallic and composite wheels known to the prior art. They are configurated to perform effectively each of the milling functions: crushing, shearing and grinding. The milling wheels of this invention are preferably composite in the sense that they are fashioned from both metal and stone elements. The composite wheels taught by this disclosure are designed to maximize the heat conductivity of the wheels by maintaining a very high proportion of the mass of the wheel metallic. Crushing and shearing are accomplished principally by the interaction of structures (preferably of metal) within the central portion of the wheels. Nevertheless, the surface area of each wheel devoted to the grinding function is substantial, in fact, greater than typical grinding wheels of the prior art. The grinding element of each composite wheel is a shallow cast stone ring with a large surface-to-volume ratio.

The matched set of this invention comprises a stator wheel and a rotor wheel, adapted for mounting with corresponding milling surfaces juxtaposed. Each wheel includes a central recessed section so that the mounted wheels together define a central cavity adapted to receive grain through an axial bore through the back of the stator. In composite wheels, the aforementioned grinding ring of cast stone surrounds this recessed section which may be regarded as a crushing section. The respective wheel elements are configurated so that when they are installed with the stone grinding surfaces in registration with each other, their respective interior structures are also in registration to define an interior crushing section within the central cavity referred to hereinbefore. The interior crushing section comprises a primary zone, including spaced vanes or cutting teeth carried by each wheel so that as the rotor spins or turns on its axis, the rotor teeth and stator teeth cooperatively crush and cut grain to reduce it to smaller grain particles. This action may be regarded as "primary shearing". The interior crushing section further comprises a secondary zone at its perimeter including spaced access grooves carried by each wheel to cooperatively crush and cut grain particles, further reducing their size ("secondary shearing"). These grooves also provide an improved travel path for grain and grain particles from the interior of the wheels to the peripheral grinding interface between the opposed wheels.

The preferred geometry and relationships of the aforedescribed elements and zones of the interior crushing section will be described in greater detail hereinafter. These features themselves constitute important improvements which are applicable to metallic or ceramic milling wheels, as well as to the composite wheels disclosed herein. However, for the sake of brevity, this specification is directed principally to a full description of the milling wheels presently regarded as most advantageous in all of its aspects. It is recognized that one or more of the novel features disclosed herein could be separately utilized to advantage while foregoing the advantages associated with certain of the other features suggested herein.

According to the presently preferred embodiments, each of the wheels of the matched set of milling wheels comprises a metal base member, (generally a metal casting), the full diameter of the wheel, with its half of the central crushing section separated from a peripheral recessed shoulder (adapted to receive a cast stone ring) by a concentric thin metal rim. An annular cast stone ring is then bonded to the peripheral recessed shoulder to provide the grinding section of the milling wheel. The metal base element may be of cast iron, but is preferably of aluminum because of aluminum's greater conductive properties, lighter weight and easier machinability.

Certain embodiments of the invention which utilize aluminum base members include the additional feature of coating the metallic milling surfaces with iron, steel, or other abrasion-resistant surface. This coating functions both to protect the relatively softer aluminum surfaces from abrasion and to satisfy the preference of a large section of the consuming public that foodstuffs be kept out of contact with aluminum.

The interior portion of the crushing section of each wheel comprises a plurality of cutting teeth extending from the inside perimeter of the grinding section inward into the central cavity. The stator teeth and rotor teeth together comprise a primary shearing zone wherein the interaction of the rotor teeth turning against the stator teeth crushes and cuts grain kernels into particles of reduced size. One of the wheels, preferably the stator, has at least one more tooth than the other wheel. Preferably, the rotor has an even number (e.g., six) of such teeth, while the stator has an odd number (e.g., seven) such teeth. In each instance, the teeth are approximately evenly spaced about the perimeter. Each tooth extends upward from the inner surface of the metal base member to approximately the plane of the grinding surface of the wheel (preferably within one or two thousandths of an inch). The teeth are thus held slightly out of contact with each other even when the wheels are closed so that their opposing grinding surfaces touch. The leading edge of each tooth is ramped, that is sloped slightly downward, to define a rake angle so that an opposing teeth meet, grain can enter between opposing ramps to be crushed. Grain is cut between the opposing tooth surfaces trailing the ramps as the rotor teeth are carried around past the stator teeth.

Each rotor tooth preferably slopes slightly, e.g., about 5° to about 20° with respect to the radius of the wheel, so that the axis of each tooth forms a tangent with a reference circle (sometimes called an action circle) concentric with the rotor perimeter and the aforementioned metal rim. The action circle is typically about 1/10 to about ¼ the diameter of the crushing section, and the inner ends of the teeth should lead the radius which intersects the tooth axis at the rim of the crushing section. The cutting teeth of the stator are desirably also sloped in opposition to the rotor teeth so that as the rotor turns, the inner end of a rotor tooth first meets the inner end of a stator tooth, and the teeth thereafter cooperatively effect a scissoring action progressing towards the rim.

By providing, for example, one more tooth on the stator wheel than the rotor wheel, the shock load transmitted from the milling wheels to the power source is minimized. Because no more than one pair of teeth is initiating shearing at any given instant, the primary shearing function is distributed over many more occurrences per revolution than where all rotor teeth pass a corresponding stator tooth at the same instant. An embodiment of the present invention in which the stator carries seven teeth and the rotor carries six teeth may be compared with typical milling wheels of the prior art wherein both wheels carry six teeth, as follows:

| | Present Invention | Prior Art |
|---|---|---|
| Number of stator teeth | 7 | 6 |
| Number of rotor teeth | 6 | 6 |
| Number of primary shearing actions per cycle | 42 | 36 |
| Shock load per primary shearing action | 16⅔% | 100% |

The crushing section further comprises a series of grooves spaced around the periphery, through the rim of the central cavity, to provide access for fragments of grain leaving the cutting teeth to migrate from the crushing section into contact with the stone grinding surfaces. These grooves are desirably sloped in the same direction (that is, the slope angle is of the same sign) as the teeth and constitute a secondary shearing zone. In other words, the axes of the grooves form a tangent to a reference circle of greater diameter than the action circle of the cutting teeth. Thus, as the access grooves of the rotor pass corresponding grooves in the stator, the interacting grooves provide additional cutting and crushing action to reduce the size of grain fragments ultimately entering into contact with the grinding interface. At this interface, grinding is accomplished in conventional fashion. The slope of the grooves with respect to the radius of the wheels is preferably greater (e.g., double) that of the teeth. The scissoring action of the teeth, of course, tends to force grain particles towards the secondary shearing zone.

The cast stone grinding ring is preferably of the least depth required to provide the rigidity and strength needed for the application. Typically, cast rings about one-fourth to about one-half inch thick are sufficient, thereby permitting a substantial mass of metal in contact with the stone. (Of course, thicker cast stone rings may be used.) In this fashion, heat generated by the grinding action of the stones is dissipated through the metal to radiate into the atmosphere. The temperature of the wheels is thus kept below tolerable limits. In practice, it has been found, particularly in grinding wet grains, that temperatures very much exceeding the boiling point of water may be generated in home grain mills of this type, and ultimately the flour produced can be scorched. The incidence of such excessive temperatures, which are detrimental to both the palatability and the nutritional value of the flour, is minimized by the composite wheel structures of this invention.

DESCRIPTION OF THE DRAWINGS

In the drawings, which illustrate what is presently regarded as the best mode for carrying out the invention.

DESCRIPTION OF THE ILLUSTRATED EMBODIMENT

Figure 7:
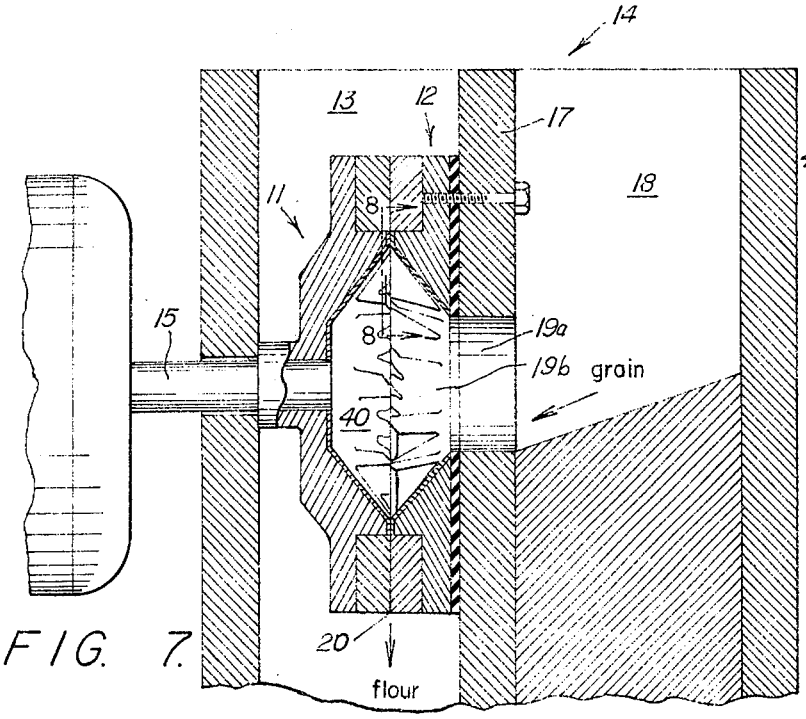
FIG. 7 is a fragmentary view in section of the grinding and hopper compartments of a home grain mill illustrating the milling wheels of FIGS. 1 and 4 assembled therein.

The illustrated milling wheels comprise a rotor 11 and a stator 12. The fashion in which these wheels are mounted in the grinding chamber 13 of a home grain mill 14 is best illustrated by FIG. 7, from which it may be seen that the rotor element 11 is fixed to the distal end of a motor shaft 15 and the stator element 12 is securely fastened to a mounting plate 17 which defines the front wall of a hopper 18. Grain introduced into the hopper 18 flows through matched feed holes 19*a*, 19*b* through the plate 17 and the back of the stator 12, respectively. As the rotor 11 turns within the grinding chamber 13, grain is ground through the interaction of opposed milling surfaces of the rotor 11 and stator 12. Flour works its way out between the grinding interface 20 to drop through the bottom of the grinding chamber into a suitable container (not shown) below.

Figure 3:
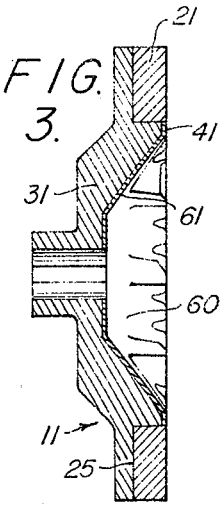
FIG. 3 is a view in section of the rotor wheel of FIG. 1 taken along the section line 3—3 as viewed in the direction of the arrows.
Figure 5:
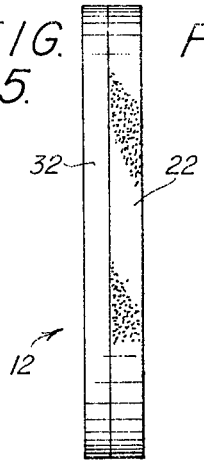
FIG. 5 is a side view in elevation of the stator wheel of FIG. 4.
Figure 6:
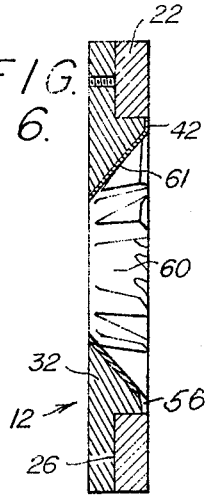
FIG. 6 is a view in section of the stator wheel of FIG. 4 taken along the section line 6—6 as viewed in the direction of the arrows.

As is clear from the drawings, the final milling or flour grinding action occurs between the opposed milling faces of annular, ring-shaped, cast stone elements 21, 22, which comprise the outermost portions of the milling surfaces of the rotor 11 and stator 12, respectively. These cast stone rings 21, 22 are seated on shoulders 25 and 26 provided in a rotor casting 31 and stator casting 32, respectively, all as best illustrated in cross section by FIGS. 3 and 6, respectively. Before this grinding can occur, the grain is subjected to the interaction of structure contained within a central crushing section 40. This section (or cavity) 40 is defined by a metal rim 41 carried by the rotor 11 juxtaposed to a corresponding metal rim 42 carried by the stator 12. These rims 41, 42 are integral with the metal castings 31, 32, respectively.

The internal crushing section 40 includes cutting teeth 45 (rotor teeth) extending inward from rim 41 of the rotor 11 and corresponding teeth 46 (stator teeth) extending inward from the rim 42 of the stator 12. As illustrated, the rotor 11 carries six rotor teeth 45, while the stator 12 carries 7 stator teeth. These cutting teeth 45, 46 cooperatively comprise a primary shearing zone, the effectiveness of which is greatly enhanced by certain structural details. In the description which follows, the direction of rotation of the rotor 11 (shown by the arrows designated A) should be borne in mind.

Figure 1:
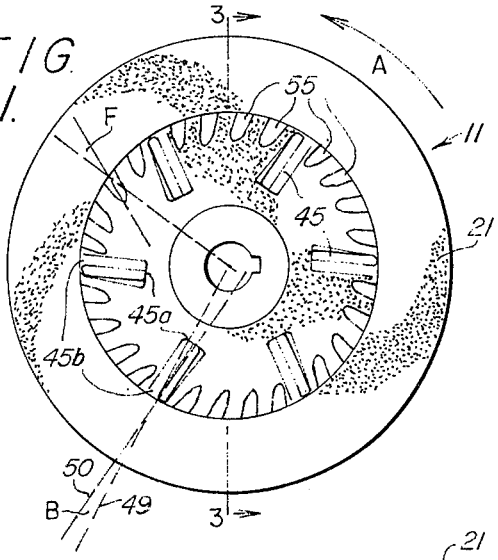
FIG. 1 is a plan view of a rotor wheel of this invention, looking towards the milling surface of the wheel.
Figure 4:
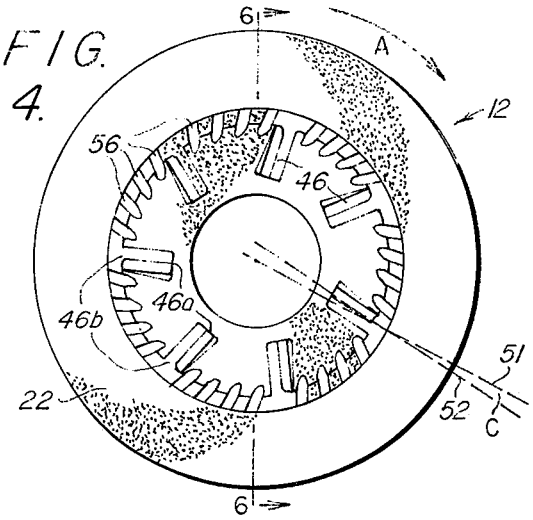
FIG. 4 is a view similar to FIG. 1 of a stator wheel of this invention.
Figure 2:
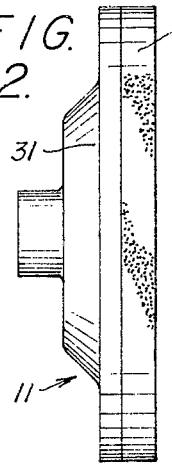
FIG. 2 is a side view in elevation of the rotor wheel of FIG. 1.

FIG. 1 shows how each rotor tooth 45 is oriented with respect to a reference line 49 congruent with the radius which intersects the rim 41 at the axis line 50 of a tooth 45. The lines 49, 50 enclose an angle B of approximately 15°, although this angle may be varied in certain instances from nearly 0° to 20° or more. The angle B is set by the "action circle" selected for the rotor as explained previously herein. It should be noted that the inner (tip) end 45*a* of the tooth 45 leads the outer (rim) end 45*b* of the tooth 45 as the rotor 11 turns on its axis. The reference line 51 and axis 52 of the stator teeth 46 define a corresponding angle C which may be, but is not necessarily, the same as B. Again, the inner (tip) end 46*a* of each stator tooth 46 "leads" the outer (rim) end 46*b* of that tooth 46 in opposition to the rotor teeth 45.

The leading edge 45*c* of each rotor tooth 45 is sloped or ramped at a "rake angle" D (FIG. 9), and the leading edges 46*c* of each stator tooth 46 is sloped at a similar rake angle E. The angles D and E may be identical, and ordinarily fall within the range of about 5° to about 20°.

Figure 8:
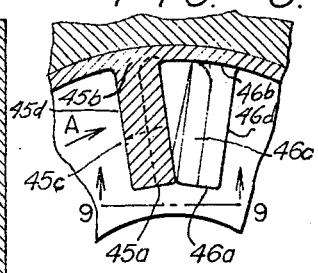
FIG. 8 is a fragmentary view partially in section of the assembled milling wheels taken along the section line 8—8 of FIG. 7 as viewed in the direction of the arrows.
Figure 9:
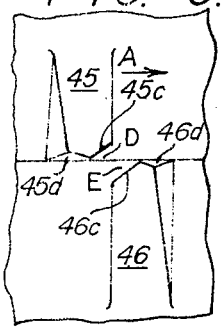
FIG. 9 is a fragmentary view of a rotor tooth and a stator tooth taken along the reference line 9—9 of FIG. 8 as viewed in the direction of the arrows.

As best illustrated by FIGS. 8 and 9, as the rotor turns on its axis, so that a rotor tooth 45 advances with respect to a stator tooth 46, grain within the central cavity 40 (FIG. 7) is first crushed between opposed surfaces 45*c* and 46*c*, and is thereafter sheared between opposed shearing surfaces 45*d* and 46*d*. Concurrently, grain and grain particles are urged from the tooth tips 45*a* and 46*a* towards the tooth rims 45*b* and 46*b*.

A plurality of spaced grooves or slots 55 is provided between each rotor tooth 45, and corresponding grooves 56 are provided between each stator tooth 46. As illustrated, there are four such grooves between each tooth for a total of 24 rotor grooves 55 and 28 stator grooves 56. These grooves cooperatively define a secondary shearing zone to further reduce the size of grain particles migrating towards the grinding interface 20. The precise number of grooves 55, 56 is not critical, but it should be noted that in the illustrated instance, relatively few of the grooves 55 can pass opposing grooves 56 at the same instant, thereby spreading the shock load in the secondary zone in the same fashion as explained hereinbefore with respect to the primary shearing zone.

The grooves may be oriented in any direction or combination of directions and still enhance the milling results of the wheels, 11, 12. Preferably, however, the grooves 55, 56 are all slanted or sloped in the same fashion as the associated teeth 45, 46, respectively, ideally at a much greater angle F, e.g., approximately double the angles B and C. A secondary function of the grooves 55, 56 is to provide easier access of grain fragments and particles past the rims 41, 42 to the grinding interface 20.

The stone rings 21, 22 may be bonded by any suitable system, e.g., epoxy, to the appropriate metal base member 31, 32. Preferably, the milling surfaces of the rings will extend beyond the milling surfaces of the rims 41, 42 by a short distance, normally no more than about 0.005 inch. In time, the stone milling surfaces may be eroded away so that the stone and metal surfaces are approximately coplaner.

The metal base members may be cast from steel or cast iron, but it is presently preferred to form these members 31, 32 from aluminum. Aluminum is especially preferred for the rotor 11. As illustrated, the interior metal surfaces 60 of both the members 31 and 32 are coated with a thin layer 61 of abrasion-resistant material, in this case iron. This coating is ideally applied by plasma flame spraying techniques which produce a metallurgical bond, although suitable coatings may be applied by other techniques. U.S. Pat. Nos. 2,707,691; 2,906,612; 2,964,420; 2,984,555; 3,042,508; 3,248,189; 3,337,264; and 3,496,682 all contain disclosures of techniques and materials useful for applying abrasive-resistant coatings to metal substrates. The presently preferred metallurgically bonded iron coatings range in thickness from about 5 to about 8 mils, although coatings of about 3 to about 12 mils are acceptable.

Reference herein to details of the illustrated embodiment is not intended to limit the scope of the appended claims which themselves recite those features regarded as essential to the invention.

I claim:

1. In a set of milling wheels for home grain mills comprising a rotor adapted for mounting on a driven shaft with the milling surface of the rotor facing out from the end of the shaft and a stator adapted for mounting with its milling surface juxtaposed in registration with the milling surface of the rotor so that the registered milling surfaces together define a central cavity adapted to receive grain from an outside supply and to reduce said grain to grain particles as the rotor turns on its axis and a peripheral interface adapted to grind said particles to flour as they are urged from said central cavity outward by the spinning rotor, the improvement which comprises:

a stator with a central bore to admit grain to said central cavity and a milling surface within said cavity including evenly spaced cutting teeth radiating from the proximity of the peripheral interface inward, each said tooth having a milling surface comprising a leading ramped portion with a rake angle; and a rotor with a milling surface within said central cavity including evenly spaced cutting teeth, of a number different from the number of such teeth associated with the stator, radiating from the proximity of the peripheral interface inward, each said tooth having a milling surface comprising a leading ramped portion with a rake angle;

the leading ramped portion of said stator teeth being opposed to the leading ramped portion of said rotor teeth so that grain is crushed between said ramped portions as the rotor turns on its axis.

2. An improvement in accordance with claim 1 wherein the axis of each stator tooth forms a tangent with the circumference of a reference circle concentric with said stator and having a diameter between about 1/10 to about ¼ of the diameter of said central cavity, and the axis of each rotor tooth forms a tangent with the circumference of a reference circle concentric with said rotor and having a diameter between about 1/10 and about ¼ of the diameter of said central cavity, the orientation of said stator teeth being opposed to that of said rotor teeth so that as the rotor turns on its axis, the inner end of a rotor tooth passes the inner end of a stator tooth before the peripheral ends of said teeth pass each other, thereby to urge grain caught between said teeth towards the peripheral interface.

3. An improvement according to claim 2 wherein the rake angles of the ramped portions of said stator teeth and said rotor teeth are between about 5° and about 10°.

4. An improvement according to claim 3 wherein the angles establishing the tangent orientations of the stator teeth and rotor teeth are between about 5° and about 20°.

5. An improvement according to claim 1 wherein each wheel comprises:

a metal base member approximately the diameter of the wheel, said base member including that wheel's portion of the central cavity and cutting teeth enclosed within an integral metal rim; and a cast stone ring member mounted on said base member peripheral to said metal rim in a recessed shoulder so that the grinding surface of said wheel is no more than about 5 thousandths of an inch above said rim.

6. An improvement according to claim 5 wherein each wheel is provided with grooves in said metal rim to provide access of grain particles from said central cavity to said peripheral grinding interface.

7. An improvement according to claim 6 wherein the axis of each stator tooth forms a tangent with the circumference of a reference circle concentric with said stator and having a diameter between about 1/10 to about ¼ of the diameter of said central cavity and the axis of each rotor tooth forms a tangent with the circumference of a reference circle concentric with said rotor and having a diameter between about 1/10 and about ¼ of the diameter of said central cavity, the orientation of said stator teeth being opposed to that of said rotor teeth so that as the rotor turns on its axis, the inner end of a rotor tooth passes the inner end of a stator tooth before the peripheral ends of said teeth pass each other, thereby to urge grain caught between said teeth towards the peripheral interface.

8. An improvement according to claim 7 wherein the axis of each groove forms a tangent with a reference circle of greater diameter than the first named reference circle and wherein the slope of each groove is of the same sign as the slope of the cutting teeth in said wheel.

9. An improvement according to claim 8 wherein said metal base member is cast from aluminum, and the milling surfaces thereof are coated with a material more abrasion-resistant than aluminum.

10. An improvement according to claim 9 wherein said milling surfaces are coated with ferrous metal applied by plasma-coating techniques.

11. An improvement according to claim 7 wherein the number of cutting teeth carried by the stator differs from the number of such teeth carried by the rotor by one.

12. An improvement according to claim 11 wherein the stator carries an odd number of cutting teeth.

13. An improvement according to claim 12 wherein the stator carries seven cutting teeth and the rotor carries six cutting teeth.

14. In a set of milling wheels for home grain mills comprising a rotor adapted for mounting on a driven shaft with the milling surface of the rotor facing out from the end of the shaft and a stator adapted for mounting with its milling surface juxtaposed in registration with the milling surface of the rotor so that the registered milling surfaces together define a central cavity adapted to receive grain from an outside supply and to reduce said grain to grain particles as the rotor turns on its axis and a peripheral interface adapted to grind said particles to flour as they are urged from said central cavity outward by the spinning rotor, the improvement which comprises each wheel being constructed of:

a metal base element approximately the full diameter of said wheel and including that wheel's portion of said central cavity enclosed within a rim with internal crushing structure contained within the cavity and approximately coplaner with said rim and a peripheral shoulder portion recessed with respect to said rim; and a cast stone ring bonded to said recessed shoulder portion so that the grinding surface of said ring extends to at least the milling surface of said rim but not more than about 0.005 inch beyond said rim.

15. In a set of milling wheels for home grain mills comprising a rotor adapted for mounting on a driven shaft with the milling surface of the rotor facing out from the end of the shaft and a stator adapted for mounting with its milling surface juxtaposed in registration with the milling surface of the rotor so that the registered milling surfaces together define a central cavity adapted to receive grain from an outside supply and to reduce said grain to grain particles as the rotor turns on its axis and a peripheral interface adapted to grind said particles to flour as they are urged from said central cavity outward by the spinning rotor, the improvement which comprises each wheel being constructed of:

a metal base element approximately the full diameter of said wheel and including that wheel's portion of said central cavity enclosed within a rim and a peripheral shoulder portion recessed with respect to said rim;

a cast stone ring bonded to said recessed shoulder portion so that the grinding surface of said ring extends to at least the milling surface of said rim; and wherein the stator has a central bore to admit grain to said central cavity and a milling surface within said cavity including evenly spaced cutting teeth radiating from the proximity of the peripheral interface inward, each said tooth having a milling surface comprising a leading ramped portion with a rake angle, and the rotor has a milling surface within said central cavity including evenly spaced cutting teeth, of a number different from the number of such teeth associated with the stator, radiating from the proximity of the peripheral interface inward, each said tooth having a milling surface comprising a leading ramped portion with a rake angle opposed to the leading ramped portion of said rotor teeth so that grain is crushed between said ramped portions as the rotor turns on its axis.

16. An improvement according to claim 15 wherein the metal base member of said rotor is formed from aluminum.

17. An improvement according to claim 16 wherein the milling surfaces of said rotor base member are coated with a ferrous metal metallurgically bonded thereto.

18. An improvement according to claim 17 wherein said metallurgically bonded coating is between about 3 and about 12 mils thick.

* * * * *